United States Patent [19]

Haruyama et al.

[11] Patent Number: 4,835,540

[45] Date of Patent: May 30, 1989

[54] MICROSTRIP ANTENNA

[75] Inventors: Tetsuo Haruyama; Kuniaki Shiramatsu; Shigeo Udagawa; Yukihir0 Yoshikawa, all of Kanagawa, Japan

[73] Assignee: Mitsubishi Denki Kabushiki Kaisha, Tokyo, Japan

[21] Appl. No.: 906,179

[22] Filed: Sep. 11, 1986

[30] Foreign Application Priority Data

| | | | |
|---|---|---|---|
| Sep. 18, 1985 | [JP] | Japan | 60-206169 |
| Nov. 7, 1985 | [JP] | Japan | 60-249504 |
| Nov. 8, 1985 | [JP] | Japan | 60-250022 |

[51] Int. Cl.[4] ..... H01Q 00/00

[52] U.S. Cl. ..... 343/700 MS

[58] Field of Search ..... 343/700 MS File

[56] References Cited

U.S. PATENT DOCUMENTS

| | | | |
|---|---|---|---|
| 4,318,107 | 3/1982 | Pierrot et al. | 343/700 MS |

FOREIGN PATENT DOCUMENTS

| | | | |
|---|---|---|---|
| 2814505 | 3/1978 | Fed. Rep. of Germany | 343/700 MS |
| 93305 | 7/1980 | Japan | 343/700 MS |
| 91003 | 6/1982 | Japan | 343/700 MS |
| 1103316 | 7/1984 | U.S.S.R. | 343/700 MS |
| 2147744 | 5/1985 | United Kingdom | 343/700 MS |

OTHER PUBLICATIONS

"Multiband Microstrip Antenna"; NASA Tech. Brief; vol. 5, No. 1; Spring 1980; pp. 3, 4.

*Primary Examiner*—William L. Sikes
*Assistant Examiner*—Robert E. Wise
*Attorney, Agent, or Firm*—Wolf, Greenfield & Sacks

[57] ABSTRACT

A microstrip antenna offering a wide bandwidth while suppressing the standing wave ratio is obtained by interposing a conductor plate between a radiating conductor element and a ground plane conductor.

8 Claims, 9 Drawing Sheets

(NOTE) $h_2$ = CONSTANT = $0.056\lambda_0$ (NOTE) $h_1 + h_2 = 0.07\lambda_0$ $h_1/h_2 = 0.24\lambda_0$

MICROSTRIP ANTENNA

BACKGROUND OF THE INVENTION

1. Field of the Invention

This invention relates generally to a linearly polarized microstrip antenna and more particularly to a microstrip antenna capable of obtaining a larger bandwidth and providing the desired frequency characteristics of impedance by loading a conductor plate.

2. Description of the Prior Art

Generally, a microstrip antenna utilizing an unbalanced plane circuit resonator provides various advantages such as being small in size, light in weight and low in height, but, on the other hand, it involves such disadvantages as having impedance characteristics which are, for example, narrower in bandwidth.

FIGS. 1 and 2 show an example of a circular microstrip antenna in the prior art. FIG. 1 is a plan view, while FIG. 2 is a cross-sectional view thereof. In these figures, reference numeral 1 denotes a patch or a radiating conductor element of an open-circuited plane circuit with the radius "a", number 2 represents a dielectric substrate (relative dielectric constant $\epsilon_r$, thickness h) which is sufficiently thinner than the wavelength, 3 is a ground plane conductor and 4 is a feed point for feeding the radiating conductor element 1 from a coaxial line 5 at the input terminal through a feeder 6.

The operation is next explained. When energy is fed from the feed point 4, a wave is radiated from the open-circuit circumferential edge 7. The antenna shown in FIGS. 1 and 2 functions as a linearly polarized antenna.

The resonant angular frequency $\omega_0$ in the fundamental mode of the resonator can be approximately as follows:

$$\omega_0 \approx \alpha_c/a$$

$$\alpha = 1.841/\sqrt{\epsilon_r}$$

$$c = 3\times 10^8 \text{ m/sec (the speed of light in a vacuum)}$$

The bandwidth BW of the microstrip antenna is generally given as, $$BW = (S-1)/(Q\sqrt{S})$$

(S is the standing wave ratio) and the bandwidth BW depends on the Q factor (quality factor).

Here, the Q factor of a microstrip antenna is given by the following relation:

$$1/Q = 1/Q_r + 1/Q_d + 1/Q_c$$

Where, $Q_r$ is the Q factor corresponding to the radiation loss, $Q_d$ is the Q factor corresponding to the dielectric loss and $Q_c$ is the Q factor corresponding to the conductor loss.

These Q factors are approximately given by the following forms:

$1/Q_d = \tan\delta$ ($\tan\delta$ is the dielectric loss tangent of the dielectric substrate 2)

$1/Q_c = \delta_s/h$ ($\delta_s$ is the skin depth of the radiation conductor element 1 and the ground plane conductor 3)

$$1/Q_r = (4\,\mu_o c h/2.39\,\lambda_o)\cdot G_r$$

$$G_r = (\alpha^2/120)\cdot \int_0^{\pi/2} [J_1^{12}(\alpha\sin\theta) + \{J_1^2(\alpha\sin\theta)/\alpha\sin\theta\}\cdot\cos^2\theta]\cdot \sin\theta d\theta$$

Where $\mu_o = 4\pi\times 10^{-7}$ H/m (the permeability in a vacuum) and $\lambda_o$ is the free space wavelength. $G_r$ is the equivalent conductance representing the radiation loss and when $\epsilon_r$ increases, $G_r$ reduces. Therefore, in the microstrip antenna, the increase of $\epsilon_r$ of the dielectric substrate 2 results in a rise in Q value, while the increase in thickness h of the substrate causes a reduction in Q value.

When the relative dielectric constant $\epsilon_r$ of the dielectric substrate 2 increases, energy is trapped within the circular microstrip antenna, causing the value of Q to become high and this results in a decrease in radiation efficiency. Thus, it is necessary, in order to improve the radiation efficiency and widen the bandwidth, to use a thicker substrate having a lower dielectric constant.

Here, it is noted that bidirectional communication is generally employed for public communications with the bandwidth of 8%–15%.

However, the microstrip antennas of the prior art use a low dielectric constant (for example, $\epsilon_r = 2.2$) substrate of teflon or polytetrafluoroethylene (PTFE) as the dielectric substrate 2 but it has a Q value less than 100. Such microstrip antennas have not been able to provide characteristics wherein the standing wave ratio is less than 1.5 over the required bandwidth of 8% or more even when the thickness of substrate is increased. Moreover, even in a case where the relative dielectric constant $\epsilon_r$ is lowered to about 1.1–1.3 by using, for example, a honeycomb substrate and the thickness of the substrate is increased with the intention of realizing a wider bandwidth, a standing wave ratio of 1.5 or less over the required bandwidth of 8% or more has not been obtainable.

Since microstrip antennas of the prior art are formed as described above, a problem has arisen in that the reflection characteristics are deteriorated in terms of the frequency characteristics of impedance when an antenna operates as a linearly polarized antenna with the bandwidth of 8% or more for public communication, etc.

Referring now to FIGS. 3 and 4, there is shown a rectangular microstrip antenna in the prior art. FIG. 3 is a plan view and FIG. 4 is a cross-sectional view wherein reference numeral 1 denotes a radiating conductor element of an open-circuited plane circuit of width "a" and length "b", number 2 denotes a dielectric substrate (relative dielectric constant $\epsilon_r$, thickness h), 3 designates a ground plane conductor, and 4 designates a feed point for connecting a center conductor 6 of a coaxial cable 5 to the radiating conductor element 1.

The operation of the rectangular microstrip antenna is similar to the circular microstrip antenna shown in FIGS. 1 and 2 and when it is fed, it radiates a wave from an open-circuit circumferential edge 7 as a linearly polarized antenna.

The resonant frequency in the fundamental mode of the rectangular microstrip antenna is determined in a manner similar to the circular antenna. The resonant frequency is primarily determined by the length "b" of the radiating conductor element 1 and the relative dielectric constant $\epsilon_r$ of the dielectric substrate 2. On the other hand, the bandwidth primarily depends on the relative dielectric constant $\epsilon_r$ and the thickness h of the substrate 2. Although the bandwidth can be extended by making $\epsilon_r$ smaller and h thicker, the preferred range of the thickness h is limited in order to prevent the generation of a higher mode. The bandwidth of the microstrip antenna which has been put into practical use is not more than several percent.

The feed point impedance increases in value when the feed point 4 corresponds to the open-circuit circumferential edge 7, that is when m=0. Since the feed point impedance tends to decrease as the position of the feed point 4 shifts toward the center of the radiating conductor element 1, the dimension of "m" should be selected so as to match the feed point with the coaxial line 5 in impedance. At the same time, in order to prevent generation of cross-polarization, the dimension "n" should be a/2 (n=a/2).

Since the conventional microstrip antenna is constructed as above, the position of the coaxial line with respect to the radiating conductor element is limited to a particular point in view of the impedance matching and the suppression of the cross-polarization. Such problem becomes serious in terms of mounting antennas, in particular when a plurality of microstrip antennas are to be arranged at predetermined intervals to form an array antenna.

In addition, the conventional microstrip antenna has an essentially narrower bandwidth and deteriorates in reflection characteristics when applied for uses where a bandwidth of more than 8% is necessary, for example in public communication applications.

SUMMARY OF THE INVENTION

In view of the foregoing background of the invention, it is a primary object to provide a linearly polarized microstrip antenna capable of restraining the reflection characteristic over the desired bandwidth of 8% or more.

Another object of the invention is to provide a microstrip antenna wherein the position of a coaxial line with respect to a radiating conductor element can be optionally selected and the reflection characteristics are suppressed over a bandwidth of 8% or more.

The foregoing and other objects of the invention are attained generally by providing a microstrip antenna wherein a conductor plate parallel to a radiating conductor element is disposed between the radiating conductor element and a ground plane conductor and a feeder is connected to the conductor plate and the radiating conductor element for feeding from the rear side thereof.

Since the microstrip antenna accordinag to the invention loads the conductor plate connected to the feeder and feeds from the rear side of the radiating conductor element, the loaded conductor plate functions as a reactance compensating element for the input impedance characteristics which would exist when the conductor plate is unloaded, whereby the reflecton characteristics can be lowered even when a bandwidth of more than 8% is desired and the widening of the bandwidth of the microstrip antenna is thereby attained.

In accordance with the another aspect of the invention, there is provided a microstrip antenna wherein a conductor plate parallel to a radiating conductor element is disposed between the radiating conductor element and a ground plane conductor, a center conductor of a coaxial line is connected to the conductor plate, a feeder is connected to the conductor plate and the radiating conductor element, and the antenna is fed from the rear side thereof.

With such arrangement, since the conductor plate operates as a conductor between the center conductor of the coaxial line and the feeder, it is not necessary to align the axis of the center conductor with the axis of the feeder, whereby the position of the coaxial cable with respect to the radiating conductor element can be freely selected while widening the bandwidth of the antenna as mentioned above.

BRIEF DESCRIPTION OF THE DRAWINGS

The foregoing features and other aspects of the invention are explained in the following detailed description taken in connection with the accompanying drawings wherein.

DESCRIPTION OF THE PREFERRED EMBODIMENTS

Figure 1:
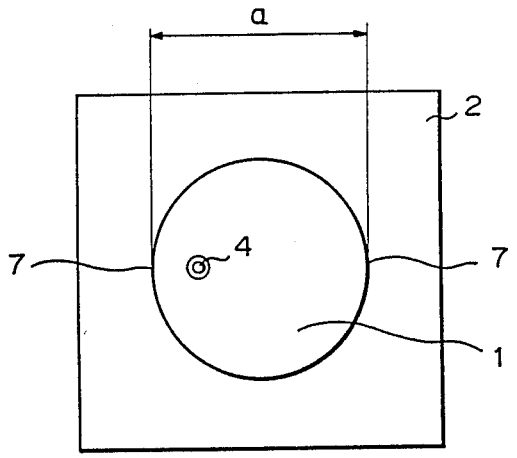
FIG. 1 is a plan view.
Figure 2:
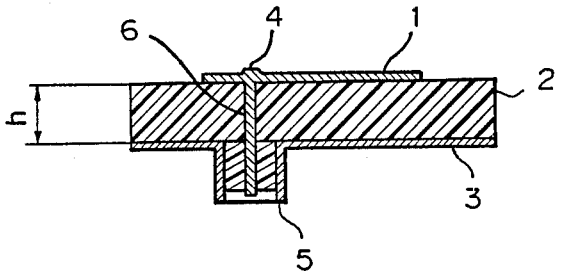
FIG. 2 is a cross-sectional view of a circular microstrip antenna in the prior art.
Figure 5:
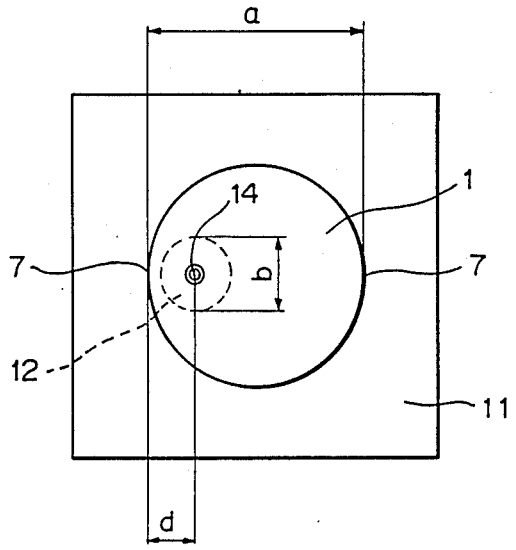
FIG. 5 is a plan view.
Figure 6:
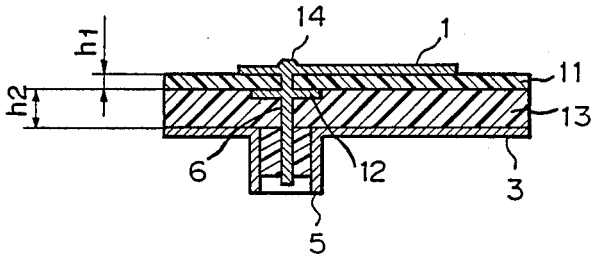
FIG. 6 is a cross sectional view of a circular microstrip antenna according to the invention.

Referring now to FIGS. 5 and 6, there is shown a plan view and a cross-sectional view of a circular microstrip antenna according to the invention. In these figures, reference numerals 1, 3, 5–7 denote the same elements as those in FIGS. 1 and 2 which show a microstrip antenna of the prior art. A first dielectric substrate 11 (relative dielectric constant $\epsilon_{r1}$, thickness $h_1$) is sufficiently thinner than the wavelength and has a radiating conductor element 1 thereon which is constructed of a circular open-circuited plane circuit with the radius "a" formed by such means as etching. On the opposite side of the element 1 with respect to the dielectric substrate 11, a circular conductor plate 12 with radius "b" is formed also by etching. A second dielectric substrate 13 (relative dielectric constant $\epsilon_{r2}$, thickness $h_2$) is also sufficiently thinner than the wavelength and has a ground plane conductor 3 on the underside thereof. A feed point 14 feeds energy by connecting a feeder 6 from a coaxial line 5 of an input terminal to the circular conductor plate 12 and the radiating conductor element 1.

The first dielectric substrate 11 and the second dielectric substrate 13 are bonded by adequate means. Here, the relative dielectric constants $\epsilon_{r1}$, $\epsilon_{r2}$ of the substrates 11, 13, respectively, are selected as 2.2 and the thickness is set to have the relationship $h_1+h_2 \approx 0.07\ \lambda_o$ ($\lambda_o$ is the free space wavelength at the center frequency $f_o$).

Figure 3:
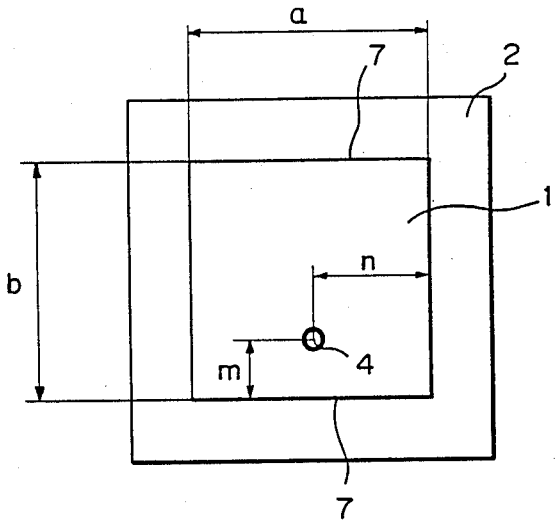
FIG. 3 is a plan view.
Figure 4:
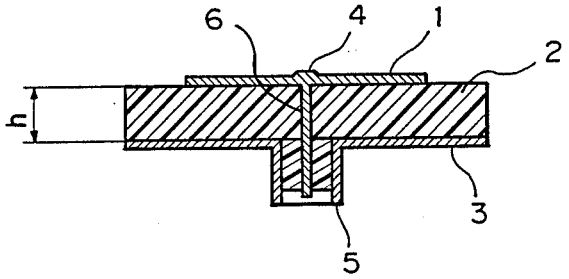
FIG. 4 is a cross-sectional view of a rectangular microstrip antenna in the prior art.
Figure 7:
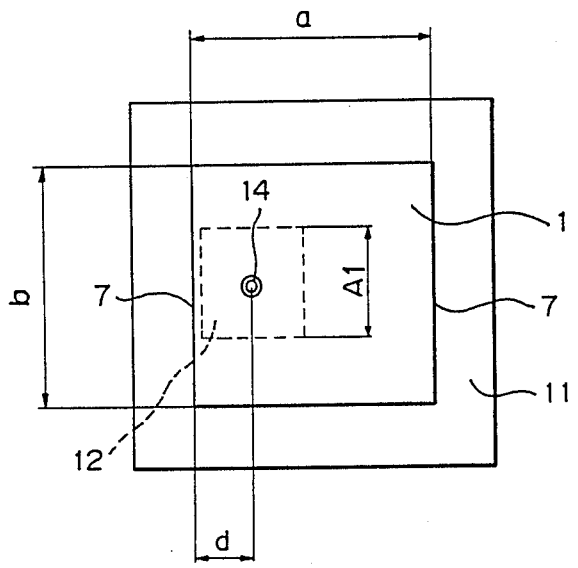
FIG. 7 is a plan view.
Figure 8:
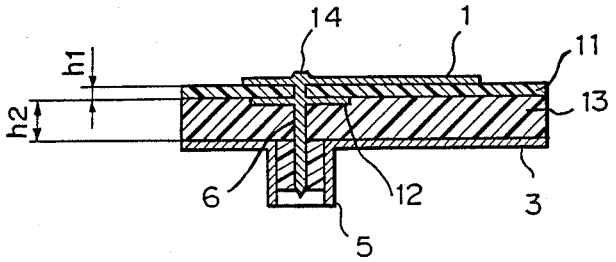
FIG. 8 is a cross-sectional view of a rectangular microstrip antenna according to the invention.

FIGS. 7 and 8 are a plan view and a cross-sectional view, respectively, of a rectangular microstrip antenna according to the invention. In these figures, reference numerals 1, 3, 5–7 denote the same elements as those in FIGS. 3 and 4 which show a microstrip antenna of the prior art. A first dielectric substrate 11 (relative dielectric constant $\epsilon_{r1}$, thickness $h_1$) is sufficiently thinner than the wavelength and has a radiating conductor element 1 thereon which is constructed of a rectangular open-circuited plane circuit of width "a" and length "b" formed by such as etching. On the opposite side of the element 1 with respect to the dielectric substrate 11, a square conductor plate 12 with dimension $A_1$ is formed by etching. A second dielectric substrate 13 (relative dielectric constant $\epsilon_{r2}$, thickness $h_2$) is also sufficiently thinner than the wave length and has a ground plane conductor 3 on the underside thereof. Reference numeral 14 denotes a feed point for feeding energy by connecting a feeder 6 from a coaxial line 5 at an input terminal to the square conductor plate 12 and the radiating conductor element 1.

The first dielectric substrate 11 and the second dielectric substrate 13 are bonded by suitable means. Here, the relative dielectric constants $\epsilon_{r1}$, $\epsilon_{r2}$ of the substrates 11, 13, respectively, are determined as 2.2 and the thickness is adjusted to have relationship $h_1+h_2 \approx 0.07\lambda$($\lambda_o$ is the free space wavelength at the center frequency $f_o$).

Figure 9:
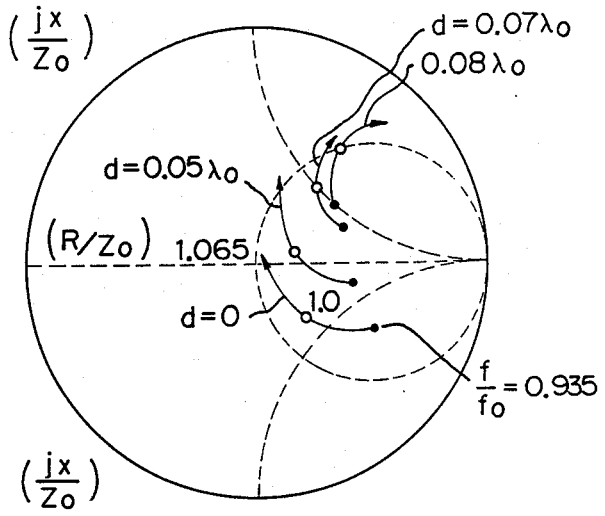
FIG. 9 is a Smith chart illustrating the effect of offset distance "d" of the feed point 14 in the case where the conductor plate 12 is not loaded.

The operation of the microstrip antennas shown in FIGS. 5, 6, 7 and 8 will now be described. FIG. 9 is a Smith chart illustrating the effect of offset distance "d" of the feed point 14 from the open-circuit circumferential edge 7 of the radiation conductor element 1 in the direction of the radius vector of linearly polarized waves, taking the position corresponding to the ground plane conductor as the phase reference when an input signal is applied to the coaxial line 5 of the input terminal in the case where the conductor plate 12 is not loaded. It has been known from experiment that the characteristics of impedance get smaller as distance "d" gets near to the radius of the radiating conductor element 1 and the antenna can be made to operate as a virtually pure inductive susceptance by suitably selecting the thickness of the first dielectric substrate 11 and the second dielectric substrate 13.

Figure 10:
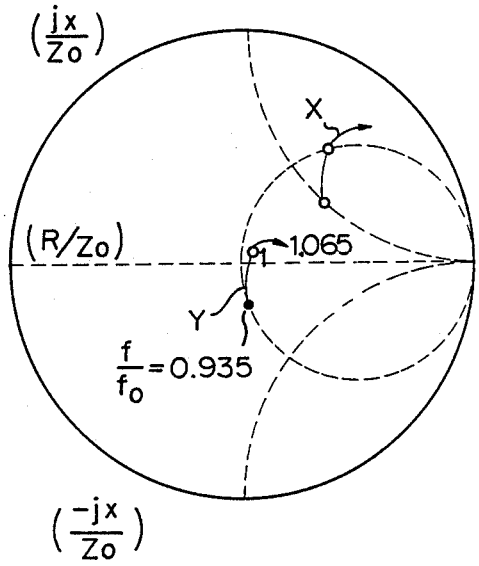
FIG. 10 is a Smith chart for explaining the operation of the microstrip antenna according to the invention.

FIG. 10 is a Smith chart explaining the operation of the microstrip antenna according to the invention and, more particularly, illustrating the effect of the conductor plate 12. In FIG. 10, "X" denotes the characteristics of the microstrip antenna without loading the conductor plate 12, while "Y" denotes that in the case of loading the plate 12, taking the position corresponding to the ground plane conductor as the phase reference when the feed point 14 is so selected that the distance "d" equals 0.08 $\lambda_o$ and an input is applied from the coaxial line 5 of the input terminal.

It is noted by referring to FIG. 10 that the conductor plate 12 functions as a reactance compensation circuit element for the input impedance characteristics of the microstrip antenna which does not include the conductor plate 12 and, as a result, the expansion of the bandwidth of the microstrip antenna is accomplished.

Figure 11:
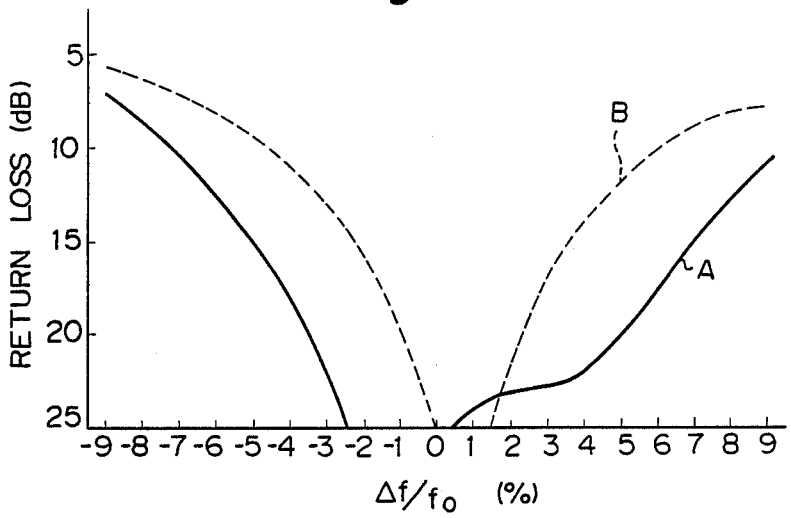
FIGS. 11 and 12 show the frequency characteristics of the return loss of microstrip antennas according to the invention (A) and the prior art (B)
Figure 12:
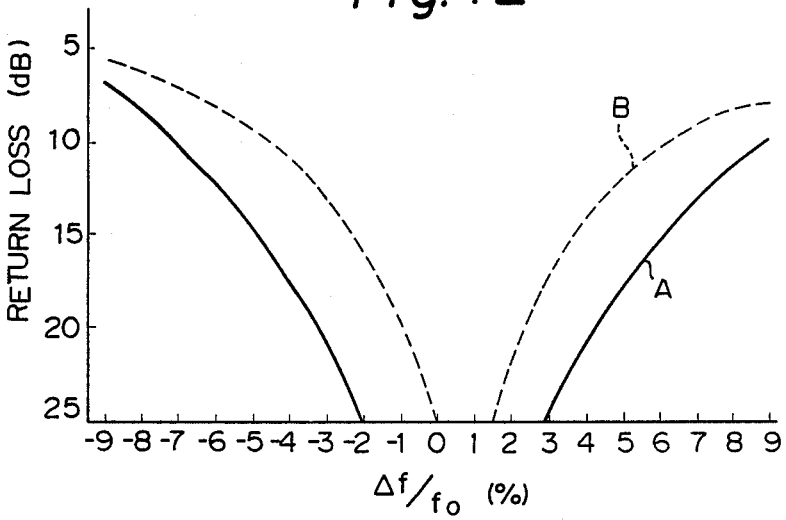

FIG. 11 shows a comparison between the frequency characteristics (A) of the microstrip antenna shown in FIGS. 5 and 6 and the characteristics (B) of that in the prior art. FIG. 12 shows a comparison between the frequency characteristics (A) of the microstrip antenna shown in FIGS. 7 and 8 and the characteristics (B) of that in the prior art. FIGS. 11 and 12 clearly reveal that the bandwidth of the microstrip antenna according to the invention is broadened in comparison with that of the prior art and more specifically that a bandwidth of 13% with the standing wave ratio less than 1.5 (the return loss more than 15 dB) is obtained.

Figure 13:
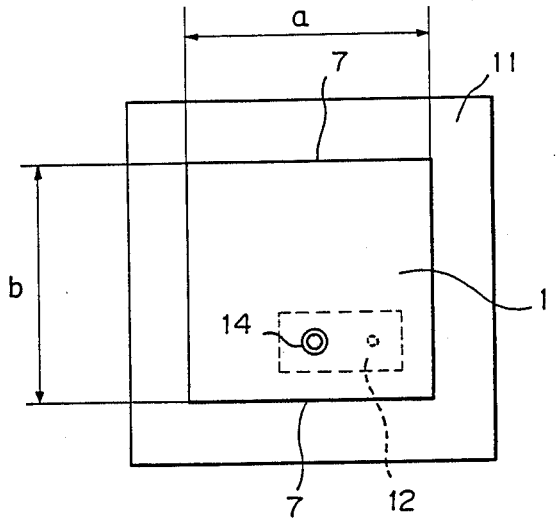
FIG. 13 is a plan view.
Figure 14:
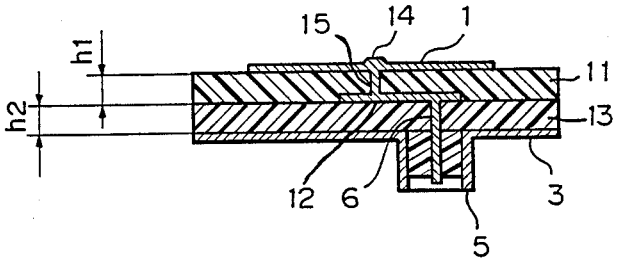
FIG. 14 is a cross-sectional view of yet another embodiment of the invention.

Referring now to FIGS. 13 and 14, there is shown yet another embodiment according to the invention, where FIG. 13 is a plan view and FIG. 14 is a cross-sectional view wherein reference numerals 1, 3, 5 and 6 denote the same elements as in FIGS. 7 and 8. In FIGS. 13 and 14, a first dielectric substrate 11 (relative dielectric constant $\epsilon_{r1}$, thickness $h_1$) is sufficiently thinner than the wavelength and has a radiating conductor element 1 thereon which is constituted by a rectangular open-circuited plane circuit of width "a" and length "b" formed by such as etching. On the opposite side of the element 1 relative to the dielectric substrate 11, a rectangular conductor plate 12 is formed also by etching. A second dielectric substrate 13 (relative dielectric constant $\epsilon_{r2}$, thickness $h_2$) is also sufficiently thinner than the wavelength and includes a ground plane conductor 3 formed on the underside thereof. Reference numeral 14 denotes a feed point for connecting a feeder 15 to the radiating conductor element 1.

Since a center conductor 6 of a coaxial line 5 is connected to the conductor plate 12 and a feeder line 15 is connected to the radiating conductor element 1 as shown, conduction between the center conductor 6 and the radiating conductor element 1 is ensured. The first dielectric substrate 11 and the second dielectric substrate 13 are bonded by suitable means.

The operation of such microstrip antenna is similar to those of the above embodiments. A radio frequency signal applied to the coaxial line 5 at the input terminal passes through the center conductor 6, the conductor plate 12 and the feeder 15 to excite the feed point 14 so that a linearly polarized wave is radiated from the open-circuit circumferential edge 7 of the radiating conductor element 1. Although the position of the feed point 14 with respect to the radiating conductor element 1 is determined in consideration of impedance matching and suppression of cross polarization in a manner similar to the conventional rectangular microstrip antenna, the position of the coaxial line 5 relative to the radiating conductor element 1 is optionally determined by suitably selecting the dimension of the conductor plate 12.

In addition, since the conductor plate 12 operates as a reactance circuit element, the frequency characteristics of input impedance of the conventional rectangular microstrip antenna are improved and the reflection characteristics are lowered over the bandwidth of 8% or more.

Figure 15:
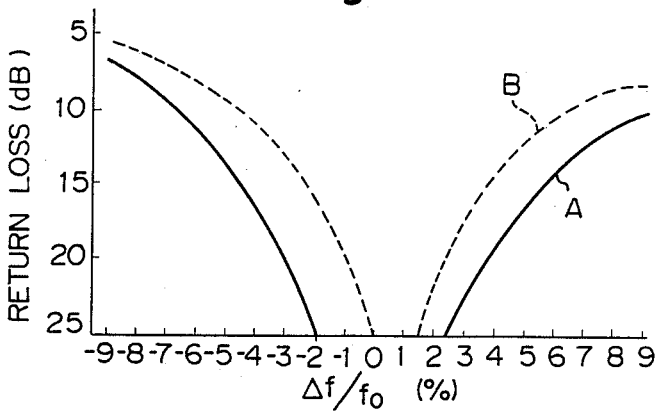
FIG. 15 shows the frequency characteristics of return loss of microstrip antennas according to the invention (A) and the prior art (B)

FIG. 15 shows the frequency characteristics of return loss of the microstrip antenna shown in FIGS. 13 and 14 (A) and the conventional antenna (B). It is easily understood from the comparison of the characteristics A and B that the bandwidth is expanded in accordance with the invention.

Figure 16:
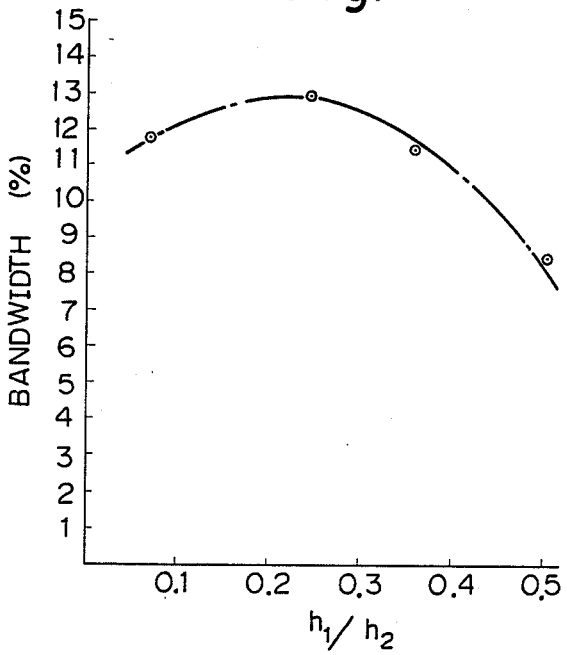
FIG. 16 is a graph of the bandwidth with the standing wave ratio of 1.5 or less measured by experiment versus the ratio $h_1/h_2$.
Figure 17:
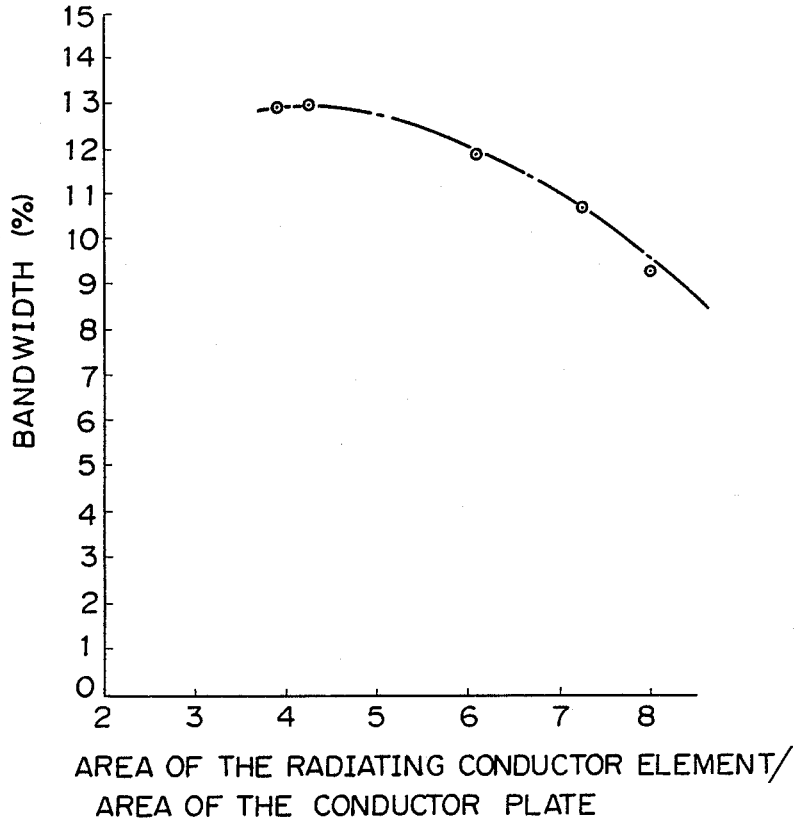
FIG. 17 is a graph of the bandwidth with the standing wave ratio of 1.5 or less measured by experiment versus the ratio of the area of the radiating conductor element to the area of the conductor plate.

As explained above, expansion of the bandwidth with the standing wave ratio less than 1.5 is very important. FIG. 16 is a graph illustrating experimental results wherein the ordinate represents the bandwidth with the standing wave ratio of 1.5 or less and the abscissa represents the ratio $h_1/h_2$. It is noted that the bandwidth of 13% is obtained when $h_1/h_2 \approx 0.24$. On the other hand, FIG. 17 is a graph illustrating experimental results wherein the ordinate represents the bandwidth with the standing wave ratio of 1.5 or less and the abscissa represents the ratio of the area of the radiating conductor element to the area of the conductor plate. It is noted that the bandwidth of 13% is obtained when the area ratio $\approx 4.25$.

In accordance with the invention, as described, since a conductor plate is disposed between and parallel to a radiating conductor element and a ground plane conductor and a feeder is connected to the conductor plate and the radiating conductor element, the bandwidth can be widened and the reflection characteristics are improved whilst offering the advantages of small size, light weight and low height. Further, since a microstrip antenna according to the invention is constructed by disposing a conductor plate between and parallel to a radiating conductor element and a ground plane conductor, connecting the center conductor of a coaxial line to the conductor plate, and connecting a feeder to the conductor plate and the radiating conductor element, the position of the coaxial line can be optionally selected, in addition to the above effects.

Having described preferred embodiments of the invention, it will be apparent to those skilled in the art that may changes and modifications may be made without departing from the concepts of the invention. For example, the shape of the conductor plate 12 is not limited to that of a circle, square, or rectangle and an elliptical or any other shape may be employed provided that it only operates as a reactance compensating element. The shape of the radiating conductor element 1 is also optional. Further, although, in the above embodiments, only a single conductor plate 12 parallel to the radiating conductor element was used, a plurality of plates may be loaded with an adequate interval therebetween by putting a plurality of dielectric material substrates or air layers between them. Furthermore, the thickness of the dielectric substrate and the relative dielectric constant thereof are not limited to 0.07 $\lambda_o$ and 2.2, respectively, and other constants or other dimension may be employed, and a honeycomb substrate may be used as the dielectric substrate.

What is claimed is:

1. In the microstrip antenna having a radiating conductor element of an open-circuited plane circuit on a dielectric substrate which is thinner than the wavelength, a feeder being connected to the radiating conductor element from the rear of a ground plane conductor disposed on the opposite side of the substrate from said radiating conductor element, the improvement comprising a conductor plate disposed between and parallel to the radiating conductor element and the ground plane conductor and electrically isolated from said ground plane conductor, the feeder being electrically conductively connected to the conductor plate and the radiating conductor element, said radiating conductor element having an area facing said conductor plate that is greater than the facing area of said conductor plate, said conductor plate being disposed in the dielectric substrate at an intermediate position between said radiating conductor element and said conductor plate and positioned solely in the area between and commonly defined by the periphery of the radiating conductor element and ground plane conductor.

2. The microstrip antenna as set forth in claim 1 wherein the ratio of the area of the radiating conductor element to the area of the conductor plate is in a range of 4:1 to 8:1.

3. In a microstrip antenna having a radiating conductor element of an open-circuited plane circuit on a dielectric substrate which is thinner than the wavelength, a coaxial line for feeding being provided at the rear of a ground plane conductor disposed on the opposite side of the substrate from said radiating conductor element, the improvement comprising a conductor plate disposed between and parallel to the radiating conductor element and the ground plane conductor and electrically isolated from said ground plane conductor, the center conductor of the coaxial line being electrically conductively connected to the conductor plate and the radiating conductor element, the ratio of the area of the radiating conductor element to the area of the conductor plate being in a range of 4:1 to 8:1.

4. The microstrip antenna as set forth in claim 1 or 3 wherein said conductor plate is spaced from said radiating conductor element by at least one dielectric layer.

5. The microstrip antenna as set forth in claim 4 wherein said dielectric layer comprises an air layer.

6. The microstrip antenna as set forth in claim 1 or 3 wherein said open-circuited plane circuit is circular.

7. The microstrip antenna as set forth in claim 1 or 3 wherein said open-circuited plane circuit is rectangular.

8. The microstrip antenna as set forth in claims 1 or 3 wherein said radiating conductor element has a feed point disposed off-center of said radiating conductor element.

* * * * *